US005875593A

United States Patent [19]

Glockner

[11] Patent Number: 5,875,593

[45] Date of Patent: Mar. 2, 1999

[54] SUPPORT MEMBER FOR CENTER SUPPORT STAIRS

[76] Inventor: Dieter Glockner, Hofackerweg 29, 91125 Schwabach, Germany

[21] Appl. No.: 895,009

[22] Filed: Jul. 16, 1997

[30] Foreign Application Priority Data

Jul. 17, 1996 [DE] Germany ..... 196 28 724.3
Jun. 5, 1997 [DE] Germany ..... 197 23 490.9

[51] Int. Cl.[6] ..... E04F 11/022

[52] U.S. Cl. ..... 52/183; 108/92; 108/95

[58] Field of Search ..... 52/183; 108/92, 108/95

[56] References Cited

U.S. PATENT DOCUMENTS 5,475,954 12/1995 Molinazzi ..... 52/183

FOREIGN PATENT DOCUMENTS 3514920 9/1995 Germany .

*Primary Examiner*—Christopher Kent
*Attorney, Agent, or Firm*—Friedrich Kueffner

[57] ABSTRACT

A support member for center support stairs is composed of a plurality of support member elements which can be connected to each other in different vertical and angular positions and each receive and support a step of the stairs. The individual support member elements are hollow section-like cast members, wherein each support member element has two outer guide surfaces located opposite each other and spaced apart from each other and extending on the same circular line. Adjacent support member elements are connected to each other through at least one screw, wherein the screw rests with its head in a recess of the respectively upper support member element. The screw extends through openings of the walls of adjacent support member elements and is screwed into a clamping jaw provided in the interior of the respectively lower support member element.

8 Claims, 2 Drawing Sheets

Fig.2
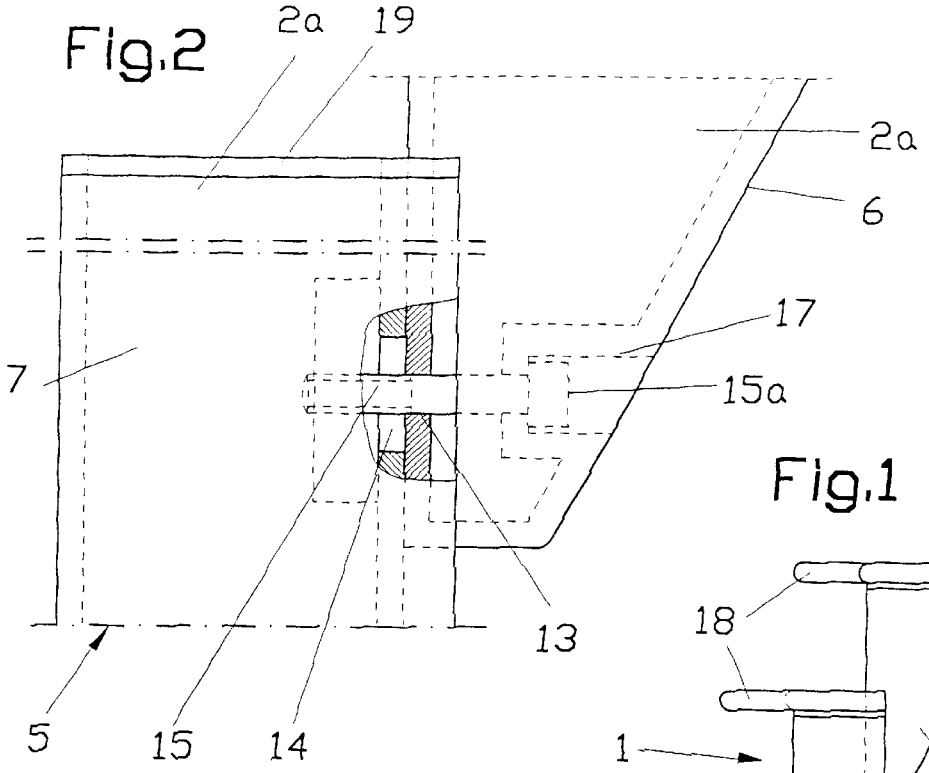
Fig.1
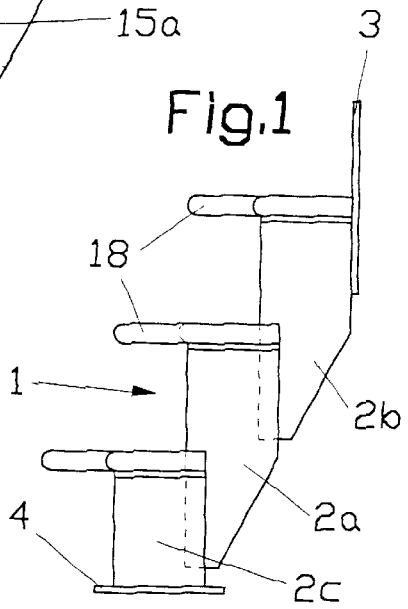
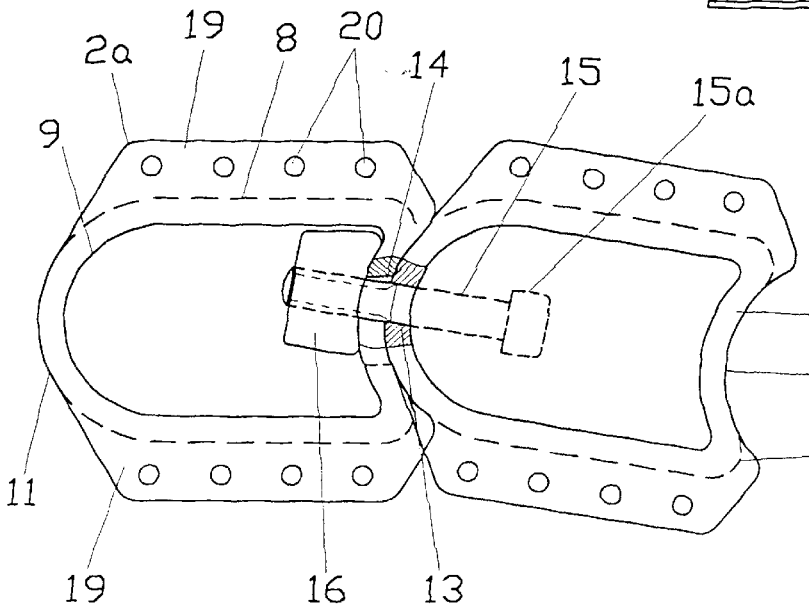
Fig.3

SUPPORT MEMBER FOR CENTER SUPPORT STAIRS

BACKGROUND OF THE INVENTION

1. Field of the Invention

The present invention relates to a support member for center support stairs, wherein the support member is composed of a plurality of support member elements which can be connected to each other in different vertical and angular positions and each receive and support a step of the stairs.

2. Description of the Related Art

DE-OS 35 14 920 discloses a support member for link-type stairs, particularly center support stairs, which is composed of support member elements which can be connected to each other in different vertical and angular positions. Each support member element serves to receive and support a step of the stairs. Each support member element of the known support member is composed of a pipe piece, wherein free ends of the sides of a U-shaped stirrup are welded to oppositely located sides of the pipe piece. The pipe piece of an adjacent, lower support member element can then be inserted into this U-shaped stirrup and can be clamped by means of two wedge-type pieces which can be pulled together by screws. Support members of this type are manufactured of steel and are galvanized in order to prevent corrosion. During assembly, it cannot be excluded that the zinc layer is damaged and the formation of rust occurs. Because steel is used as the material of the support member, the individual support member elements and, thus, the support member, have a relatively high weight. Distortions may occur when the welding seams are produced, so that not only the assembly, but also the optical impression of the support member are negatively affected. The configuration of the individual support member elements cannot be exactly called elegant which has a negative effect on the optical impression of the support member. The welding seams also contribute to this negative impression.

SUMMARY OF THE INVENTION

Therefore, it is the primary object of the present invention to construct a support member of the above-described type composed of several support member elements in such a way that the individual support member elements are no longer distorted by welding seams, that the assembly is simplified while providing a secure clamping action, and that the support member has a particularly attractive appearance.

In accordance with the present invention, in a support member of the above-described type, the individual support member elements are hollow section-like cast members, wherein each support member element has two outer guide surfaces located opposite each other and spaced apart from each and extending on the same circular line, and wherein adjacent support member elements are connected to each other through at least one screw, wherein the screw rests with its head in a recess of the respectively upper support member element, and wherein the screw extends through openings of the walls of adjacent support member elements and is screwed into a clamping jaw provided in the interior of the respectively lower support member element.

A support member composed of individual support member elements as described above can be manufactured in a simple manner and without great expense. Since welding seams are no longer required, the danger of distortion of the support member elements and, thus, an impairment of the support member, are prevented. The individual support member elements provide a good optical impression and the support member has an appearance which can be called elegant. Because the support member elements have a compact configuration, the support member can be packed easily and, thus, can be transported or shipped easily. Moreover, the screw which is providing the clamping action in this support member is always accessible and, thus, readjustable.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is an elevational view of a support member according to the present invention;

FIG. 2 is a side view, partially in section and on a larger scale, of the connecting area between two support member elements;

FIG. 3 is a top view of two support member elements connected to each other.

DESCRIPTION OF THE PREFERRED EMBODIMENTS

Figure 4:
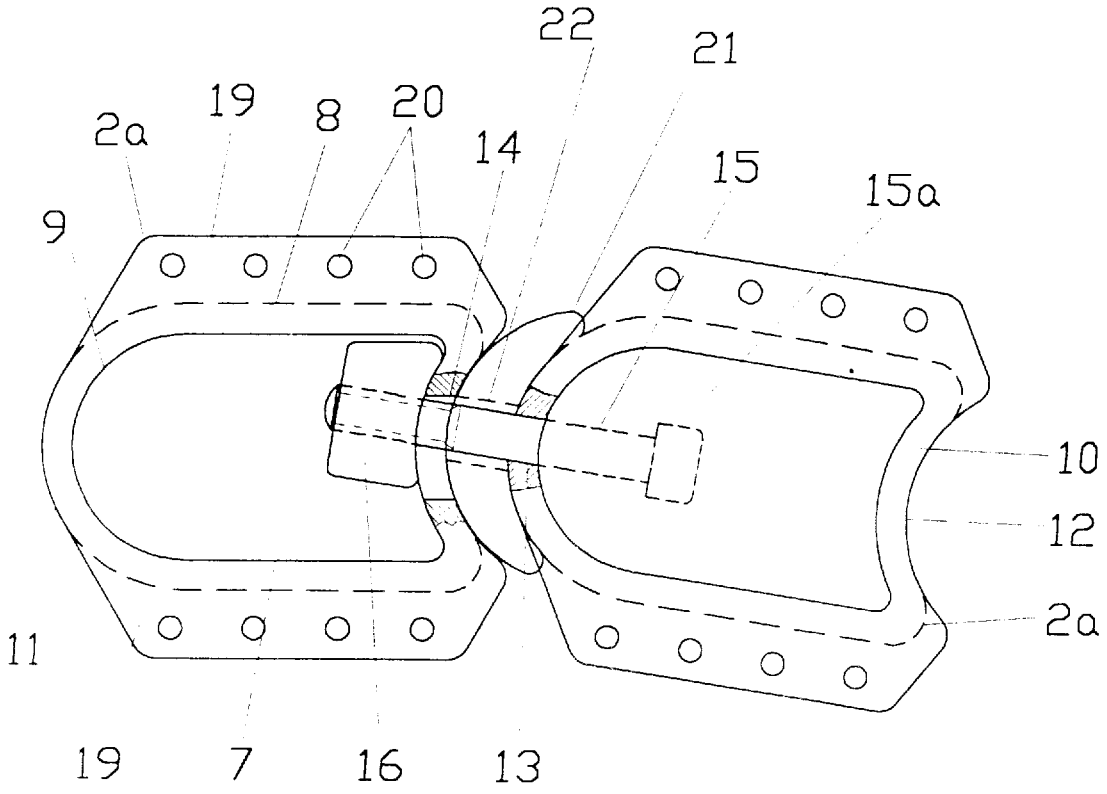
FIG. 4 is a view corresponding to FIG. 3 showing an additional intermediate piece.

FIG. 1 of the drawing shows a support member 1 according to the present invention which, in order to simplify the illustration, has only three support member elements 2*a*, 2*b*, 2*c*, wherein the support member elements 2*a*, 2*b* are of completely identical construction. The support member element 2*b* which forms the upper end of the support member 1 has a plate 3 connected to it, wherein the plate 3 is provided for connecting the support member element 2*b* and, thus, the support member 1, e.g. in the opening of a corner.

As compared to the support member element 2*a*, the support member element 2*c* has a lower portion removed and supports a plate 4 through which the support member element 2*c* which forms the lower end of the support member 1, can be fastened to a floor or the like. The plates 3, 4 can be attached to the support member elements 2*b*, 2*c* in any chosen manner. However, preferred is an attachment which facilitates a vertical adjustment and/or angular adjustment.

The support member element 2*a* which forms the so-called basic element as well as the support member elements 2*c* and 2*b* are each composed of a hollow section-like cast member 5, for example, of aluminum, which is closed at its lower end by an essentially obliquely extending wall 6. The support member element 2*a* has a prismatic portion 7 which, as can be seen in FIG. 3, is formed by two essentially plane side walls 8. The front wall 9 and the rear wall 10 of the prismatic portion are circular arc-shaped, wherein the front wall 9 has a convexly extending guide surface 11 and the rear wall 10 has a concavely extending guide surface 12. Both guide surfaces 11, 12 extend on the same circular line, so that two adjacent support member elements 2*a* can be connected to each other through the guide surfaces 11, 12.

For effecting the connection between two support member elements, the walls 9, 10 have openings 13, 14, wherein the opening 13 is provided in the lower portion and the opening 14 is provided in the upper portion of each support member element 2*a*. The opening 13 has a circular cross-section for inserting a screw 15, while the opening 14 is substantially greater than the cross-section of the screw 15. In horizontal direction, the opening 14 extends over an angle of about 20°–30°. In vertical direction, the opening 14 is oblong hole-shaped, so that, when the screw 15 is inserted, the two support member elements 2*a* can be displaced in vertical direction as well as in the angular position relative to each other and can be adjusted to the respective requirements. Advantageously, the opening 14 has a height which is selected in such a way that a vertical adjustment of about 30–40 mm is possible.

In the position illustrated in FIG. 3, the two support member elements 2*a* extend horizontally at an angle of 100 relative to each other. In order to secure the relative position of the two support member elements 2*a*, a clamping jaw 16 is inserted into the respectively lower support member element 2*a*, wherein the clamping jaw 16 extends by a predetermined dimension upwardly and downwardly beyond the oblong hole-shaped opening 14 and rests with a concave surface against the inner surface of the wall 10 and has a threaded bore for receiving the screw 15. The screw 15 is placed with its head 15*a* in a recess 17 of the outer obliquely extending wall 6. When the two support member elements 2*a* have assumed the predetermined position relative to each other, the screw 15 is tightened and the two support member elements 2*a* are tightly clamped to each other as a result. If necessary, after tightening the two support member elements 2*a*, the recess 17 may be closed by a plug, cover or the like.

When the assembly of the support member 1 composed of several support member elements 2*a*, 2*b*, 2*c* is concluded in the correct vertical and angular position, a step member 18, for example, of wood, is fastened on each support member element 2*a*, 2*b*, 2*c*. For fastening the step members 18, each support member element 2*a*, 2*b*, 2*c* has at its upper end and on both sides a flange 19 each with openings 20, wherein screws which are known in the art can be screwed into the step members 18. The position of each step member 18 on the individual support member elements 2*a*, 2*b*, 2*c* can be essentially freely selected depending on the actual requirements.

In stairs of this type, the step members 18 may have a varying width or depth. To these different widths and depths of the step members 18, the support member elements 2*a*, 2*b*, 2*c* can be adapted by constructing the support member element also with different depths from the front toward the rear, i.e., the dimension of the support area can be adapted.

However, in order not to have to provide different support member elements 2*a*, 2*b*, 2*c* for each different depth of the step members, which would make storage very expensive and which would require many different casting molds, an intermediate piece 21 as shown in FIG. 4 can be placed between two support member elements 2*a* to be connected or screwed together, wherein the intermediate piece 21 serves to space apart the support member elements 2*a*.

The intermediate piece 21 has on its two oppositely located surfaces which interact with a support member element 2*a*, respectively, a radius which over a large area is at least essentially the same as the radius of the support member element 2*a*. In addition, the intermediate piece 21 is provided with an opening 22 for inserting the screw 15. As seen perpendicularly to the plane of the drawing, this opening 22 may be constructed as an oblong hole. The thickness of each intermediate piece 21 may be between 1 and 5 cm. Advantageously, the interacting surfaces or connecting surfaces of the support member elements 2*a* and/or the intermediate pieces 21 may be provided with ribs, projections or other rough features, so that the clamping action and the stability are improved.

In a modified embodiment of the present invention described above, the shape and the cross section of the support member elements 2*a*, 2*b*, 2*c* can be selected essentially freely. However, it is decisive that always two guide surfaces 11, 12 extending on the same circular line, or the same radius are provided. The recess 17 for receiving the screw head 15*a* can be arranged or constructed differently in order to adapt to the requirements of a simple casting procedure. Moreover, the support member elements 2*a*, 2*b*, 2*c* may also be of different materials.

Depending on the size of the support member elements 2*a*, 2*b* and 2*c*, the shape of the obliquely extending wall 6 may be curved or rounded. Moreover, it is possible to construct the support surface 19 in a curved shape or arc-shaped, and/or to reinforce the bottom side by ribs or the like.

While specific embodiments of the invention have been shown and described in detail to illustrate the inventive principles, it will be understood that the invention may be embodied otherwise without departing from such principles.

I claim:

1. A support member for center support stairs, the support member comprising a plurality of support member elements connectable to each other in different vertical and angular positions and each receiving and supporting a step of the stairs, the support member elements being hollow section-like cast members, each support member element having two walls forming outer guide surfaces located opposite each other and spaced apart from each other and having the same radius, further comprising at least one screw for connecting two adjacent support member elements to each other, the at least one screw having a head and resting with the head in a recess formed in an upper of the two adjacent support member elements, the walls of the support member elements having an opening, a clamping jaw being provided in an interior of each support member element, the at least one screw extending through the openings of the walls of the adjacent support member elements and being screwed into the clamping jaw of a lower of the two adjacent support member elements.

2. The support member according to claim 1, wherein the opening of each support member element facing the clamping jaw extends in a horizontal direction over an angle of about 20° to 30°.

3. The support member according to claim 1, wherein the opening of each support member element facing the clamping jaw is a perpendicularly extending oblong hole, and wherein the clamping jaw is mounted so as to project at both ends thereof beyond the oblong hole.

4. The support member according to claim 1, wherein the support member has a lowermost support member element and an uppermost support member element, a horizontal stop plate being mounted on the lowermost support member element and a vertical stop plate being mounted on the uppermost support member element.

5. The support member according to claim 1, wherein the support member elements are made of aluminum.

6. The support member according to claim 1, further comprising an intermediate piece mounted between the two adjacent support member elements.

7. The support member according to claim 6, wherein at least one of the support member elements and the intermediate piece have rough surface portions at surfaces facing each other.

8. The support member according to claim 7, wherein the rough surface portions have ribs or projections.

* * * * *